US006887094B2

(12) United States Patent
Boeck et al.

(10) Patent No.: US 6,887,094 B2
(45) Date of Patent: May 3, 2005

(54) SHIELDED CONNECTION ARRANGEMENT FOR DATA TRANSFER

(75) Inventors: Werner Boeck, Gross-Umstadt (DE); Franz Mueller, Griesheim (DE); Martin Szelag, Bickenbach (DE); Ralf Schmidt, Fuerth (DE)

(73) Assignee: Tyco Electronics AMP, GmbH, Bensheim (DE)

( * ) Notice: Subject to any disclaimer, the term of this patent is extended or adjusted under 35 U.S.C. 154(b) by 0 days.

(21) Appl. No.: 10/665,003

(22) Filed: Sep. 18, 2003

(65) Prior Publication Data

US 2004/0110410 A1 Jun. 10, 2004

(30) Foreign Application Priority Data

Sep. 28, 2002 (EP) ..... 02022043

(51) Int. Cl.[7] ..... H01R 4/24
(52) U.S. Cl. ..... 439/417
(58) Field of Search ..... 439/417

(56) References Cited

U.S. PATENT DOCUMENTS

| | | | | | |
|---|---|---|---|---|---|
| 3,963,319 | A | * | 6/1976 | Schumacher et al. | 439/439 |
| 4,533,199 | A | | 8/1985 | Feldberg | |
| 4,968,267 | A | * | 11/1990 | Payne | 439/410 |
| 5,188,536 | A | * | 2/1993 | Ganthier et al. | 439/83 |
| 5,295,857 | A | * | 3/1994 | Toly | 439/395 |
| 5,415,562 | A | * | 5/1995 | Matsumoto et al. | 439/397 |
| 5,695,361 | A | * | 12/1997 | Elisei | 439/535 |
| 5,947,761 | A | * | 9/1999 | Pepe | 439/409 |
| 6,572,658 | B1 | * | 6/2003 | Gramnas | 623/44 |
| 6,682,363 | B1 | * | 1/2004 | Chang | 439/409 |
| RE38,519 | E | * | 5/2004 | Doorhy et al. | 439/404 |
| 2002/0061675 | A1 | * | 5/2002 | Borst | 439/404 |
| 2004/0092153 | A1 | * | 5/2004 | Peng | 439/404 |
| 2004/0142592 | A1 | * | 7/2004 | Peng | 439/409 |

FOREIGN PATENT DOCUMENTS

| | | | | |
|---|---|---|---|---|
| DE | 42 22 452 | A1 | 1/1993 | H01R/13/648 |
| DE | 197 12 630 | C1 | 4/1998 | H01R/13/502 |
| DE | 198 53 927 | A1 | 5/2000 | H01R/13/648 |
| EP | 0735612 | * | 10/1996 | |
| EP | 0735612 | A | 10/1996 | |
| WO | WO 02/15340 | A | 2/2002 | |
| WO | WO 0215340 | * | 2/2002 | |

* cited by examiner

*Primary Examiner*—Ross Gushi
*Assistant Examiner*—Larisa Tsukerman
(74) *Attorney, Agent, or Firm*—Barley Snyder

(57) ABSTRACT

A shielded connection arrangement is provided for electrically connecting at least one multiple-conductor shielded electrical wire to a circuit carrier or the like, in particular for connecting an Ethernet line to an electrical device. The connection arrangement includes an electrically insulating housing 101 having a securable cover 102 and, located therein, insulation displacement contacts 103 for making contact with wire conductors 141 of the at least one electrical wire 14. Within the insulating housing 101 and/or below the cover 102 there is an electrically conductive shield plate 121 for shielding 12 the interior of the housing in a manner which is largely closed.

14 Claims, 7 Drawing Sheets

SHIELDED CONNECTION ARRANGEMENT FOR DATA TRANSFER

FIELD OF THE INVENTION

The invention generally relates to a shielded connection arrangement for data transfer, and more particularly to a shielded connection arrangement for making contact with an Ethernet line in industrial use.

BACKGROUND OF THE INVENTION

Various arrangements are known for connecting shielded electrical wires using housings with circuit carriers located therein. A shielded connector for connecting signal and ground between a mating connector and a printed circuit board or a cable includes a housing with an inner cavity which is formed by upper, lower and side walls and a rear wall. The surfaces of the housing are conductive in order to shield signal contacts which are located within the inner cavity and run through insulated regions in the rear wall. One construction includes a synthetic housing with a metal coating which forms a surface. Another construction includes a solid metal housing with a synthetic insert.

A terminal block for shielded cables, such as data transfer cables, comprises a lower part and an upper part made from die-cast metal. The conductors of the cables to be connected are introduced into a charge block which can be latched inside the lower part. Located in the upper part is a carrier plate on which a printed circuit board carrying socket is seated. Insulation displacement contacts are seated in the carrier plate and penetrate into the charge block in order to make contact with the conductors when the upper part is placed on the lower part and joined thereto by means of a screw connection.

A terminal block for shielded cables has a shielding housing comprising an upper part and a lower part. The cables to be connected are held by a clip which reaches around the exposed shielding of the cables. The clip is inserted in a receiver in the housing. A radial pressure presses the clip against the shielding of the cable on one side and against a receiver on the other side, in order to connect the shielding conductively to the housing. The receiver is located in the interior of the housing and holds the clip firmly in the form of a strain relief means.

A shielded connection arrangement for data transfer in an industrial environment is known, which makes contact with a shielded electrical conductor or a plurality of electrical conductors of a shielded cable without the aid of a tool. The cables are pushed into a pivotal receiver and there make contact by means of insulation displacement contacts. The pivotal receiver is fixed by means of a cover, also pivotal. The housing and the pivotal cover each have a ground connection and form a shield against electromagnetic radiation.

SUMMARY OF THE INVENTION

In an exemplary embodiment of the present invention, a shielded connection arrangement is provided for electrically connecting at least one multiple-conductor shielded electrical wire to a circuit carrier or the like. For example, the shielded connection arrangement may be used for connecting an Ethernet line to an electrical device.

The exemplary arrangement includes a housing having a securable cover with an internal cavity formed between the housing and cover when the cover is secured. Insulation displacement contacts are located within the cavity for making contact with conductors of the at least one electrical wire. The housing and the cover are made of electrically insulating material, for example synthetic material or ceramic. Within the insulating housing and/or below the insulating cover there is a shield comprising at least one electrically conductive shield plate. The shield plate may preferably be inserted into the securable cover and fixed there, and it serves to shield the connection arrangement by forming a largely closed conductive surface surrounding the connection.

This shielded connection arrangement provides a simple and lightweight construction as a result of an electrically insulating housing made of ceramic or synthetic material, into which a shield plate in the form of a simple punched part is inserted. By comparison with a known housing made of relatively heavy metal, for example hot-chamber die-cast zinc, the exemplary connection arrangement according to the invention has a significantly lower weight and a simpler method of manufacture.

The shield plate may be detachably fixed in the cover by means of resilient tongues engaging in apertures in the cover. This gives rise to a reliable mechanical connection between the cover and the shield, which is made by a latching or snap-in connection which is easy to use.

According to an exemplary embodiment of the invention, with the connection arrangement inserted into a conductive housing and with the cover closed, the resilient tongues are in conductive connection with a housing wall or a housing cover and/or with resilient tongues of an adjacent connection arrangement. Thus the shield plate makes reliable contact both with neighbouring units and with a metal housing. This reliable contact provides a high level of electromagnetic radiation shielding enhancing safety.

The cover is preferably mounted to pivot about a pivot axis fixed to the housing. Accordingly, the electrical wire may be connected in place by suspending it on the resilient tongues and pivoting the cover to a closed position. A screwdriver may be used as a lever to loosen the cover. The cover may be screwed to the housing.

In an exemplary embodiment of the invention, an additional small shield plate is provided within the housing, in electrical connection with the shield of the electrical wire. The small shield plate is fixed in a conductive connection with the shield plate when the cover is screwed on. Thus providing almost gap-free shielding of the interior of the housing from electromagnetic radiation.

The insulation displacement contacts, for making contact with the wire conductors, and the small shield plate may each be soldered to a printed circuit carrier or a printed circuit board, with the contact pins of the small shield plate preferably soldered to an ground contact of the printed circuit carrier.

In an exemplary embodiment of the invention, the housing may be secured on an underside by means of latching connections on the circuit carrier. These latching connections may be constructed, for example, as two, three or more latching tabs for latching into corresponding recesses in the circuit carrier.

In another embodiment of the invention, a conductive housing of an electrical device or a device module, has one or more shielded connection arrangements arranged next to one another. The connection arrangements described are in particular suitable for ranging next to one another in the conductive housing, with the resilient tongues each projecting out of the covers of the housings of the connection arrangements being ideally suited to making contact with two adjacent connection arrangements. The resilient tongues of the at least one connection arrangement used may be in electrical connection with a housing wall or a housing cover or with resilient tongues of an adjacent connection arrangement, or with a combination thereof.

The cover of the at least one shielded connection arrangement may, in accordance with an embodiment of the invention, end largely flush with the housing cover, with the cover preferably being capable of pivoting up and latching into an end position when an electrical connection arrangement is inserted into the conductive housing, for the purpose of laying in and making contact with a multiple-conductor shielded wire.

BRIEF DESCRIPTION OF THE DRAWINGS

The invention will be explained in detail with reference being made to the drawings, in which.

DETAILED DESCRIPTION OF THE INVENTION

Figure 1:
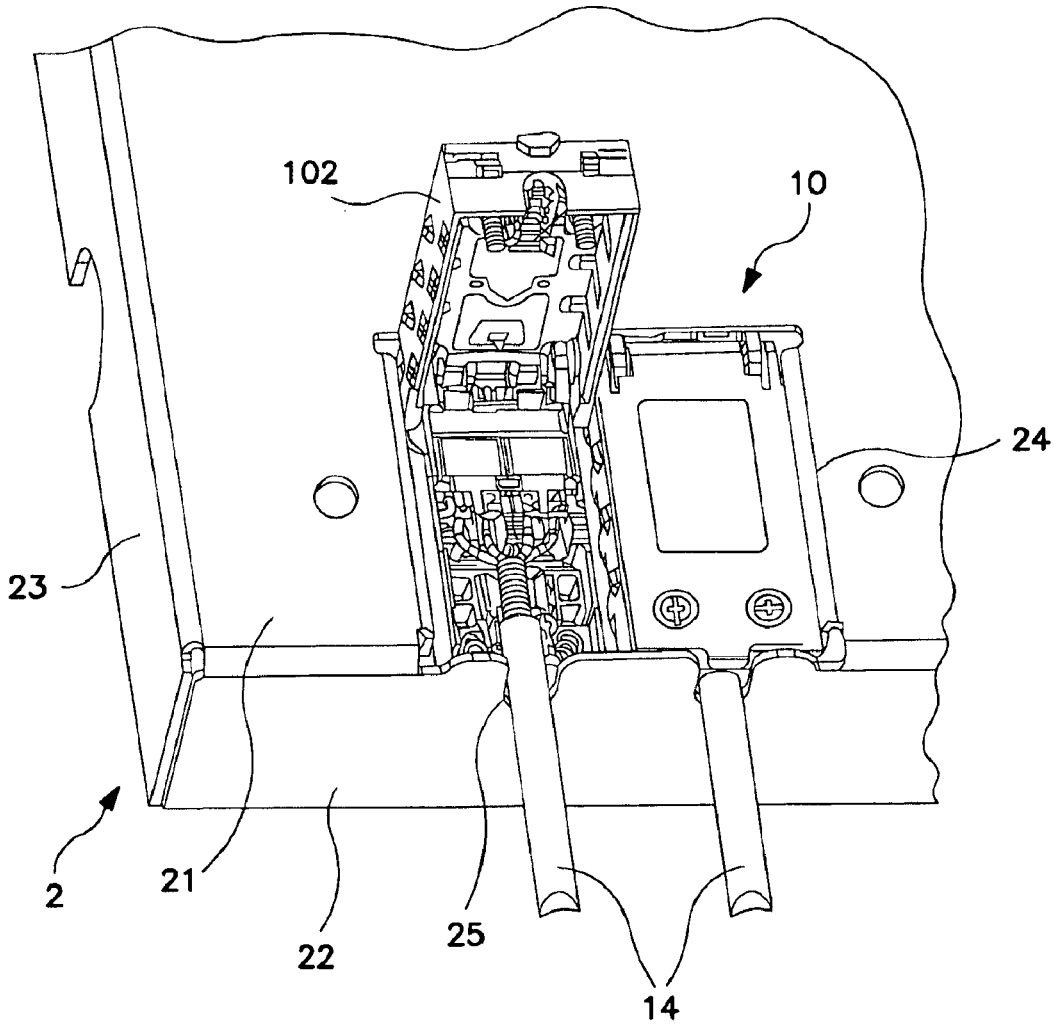
FIG. 1 shows a portion, in perspective, of a conductive housing with a connection arrangement according to an exemplary embodiment of the invention located therein.

An exemplary connection arrangement according to the invention is shown in FIG. 1. In this exemplary embodiment, a conductive housing 2 has a housing front wall 22 and a housing side wall 23, with two connection arrangements 10 disposed in the housing 2 for the purpose of making contact between shielded electrical wires 14 and a printed circuit board (not shown) which is disposed in the housing 2. The electrical wires 14 are each guided through openings or wire feedthroughs 25 in the housing front wall 22 and each end in a connection arrangement 10. A cover 102 is pivotally attached to the housing 2 at each of the connection arrangements 10, such that they pivot between an open position and a closed position. The cover of one of the connection arrangements 10 (shown on the left in FIG. 1) is pivoted upwards into the open position, revealing the connection of the electrical wire 14 with insulation displacement contacts (103 shown in FIG. 2). A cover recess 24 in the housing cover 21 exposes the upper sides of the connection arrangements 10, such that the covers 102 can be pivoted upwards and latched into an end position at any time, providing access to the electrical wire 14.

Figure 2:
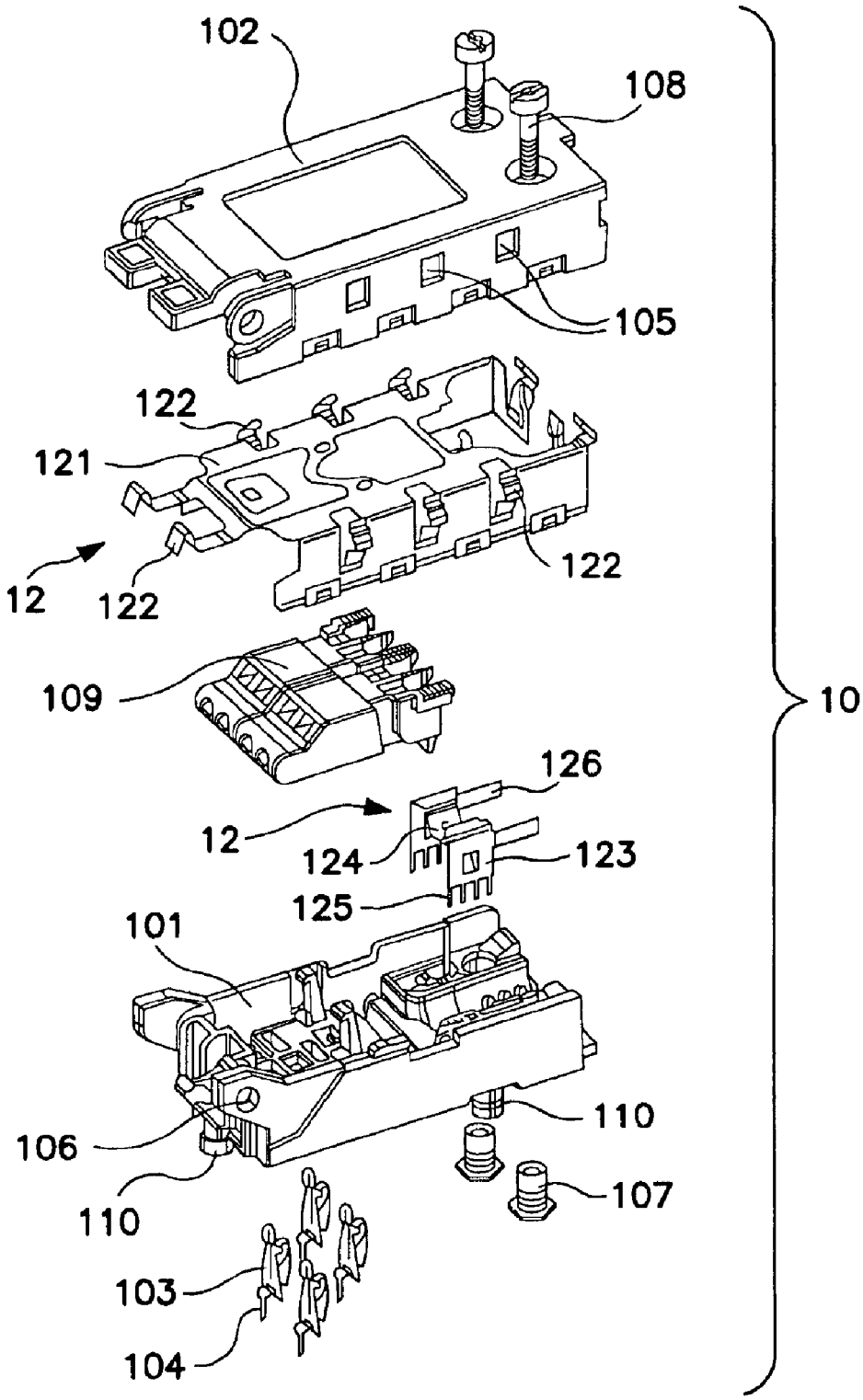
FIG. 2 shows an exploded view of the connection arrangement of FIG. 1.

FIG. 2 shows an exploded view of the connection arrangement 10 according to an exemplary embodiment of the invention, substantially comprising a housing 101 and a cover 102 which is pivotally connected thereto and connectable at an end of the cover 102 opposite the pivotal connection, such as by connectors 108. The housing 101 and the cover 102 are each made of an electrically insulating material, for example, synthetic material or ceramic. A plurality of insulation displacement contacts 103 are inserted in the housing 101 and are each soldered to a printed circuit board by means of a solder pin 104. The housing 101 has a plurality of latching tabs 110 on its underside, that are pressed into appropriate recesses in the printed circuit board to latch the housing 101 to the circuit board.

A multiple-conductor shielded wire may be placed on the insulation displacement contacts using, for example, a 'pivot cover' 109, electrically connecting the conductors to their respective insulation displacement contacts. A shield plate 121 is provided on the inside of the cover 102 covering substantially all of the entire inside of the cover. The shield plate may be pressed into the cover 102 in latching manner by means of a plurality of resilient tongues 122. The resilient tongues 122 engage in respective apertures 105 in side walls of the cover 102. The cover 102 is connected to the housing 101 so as to pivot about its pivot axis 106 and is fixedly connected to the housing 101 on a side opposed to the pivot axis 106 by means of two securing screws 108 which engage in threaded bushings 107.

Figure 3:
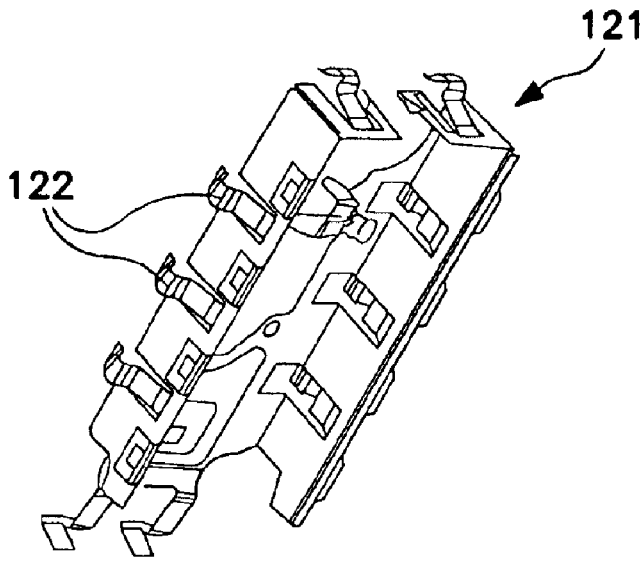
FIG. 3 shows a perspective view of a shield plate according to an exemplary embodiment of the invention.

FIG. 3 shows the shield plate 121 which may be inserted into the cover 102. The shield plate 121 has a dish-shaped contour and may be fixed in clamping manner in the cover 102 by means of a plurality of resilient tongues 122.

Figure 4:
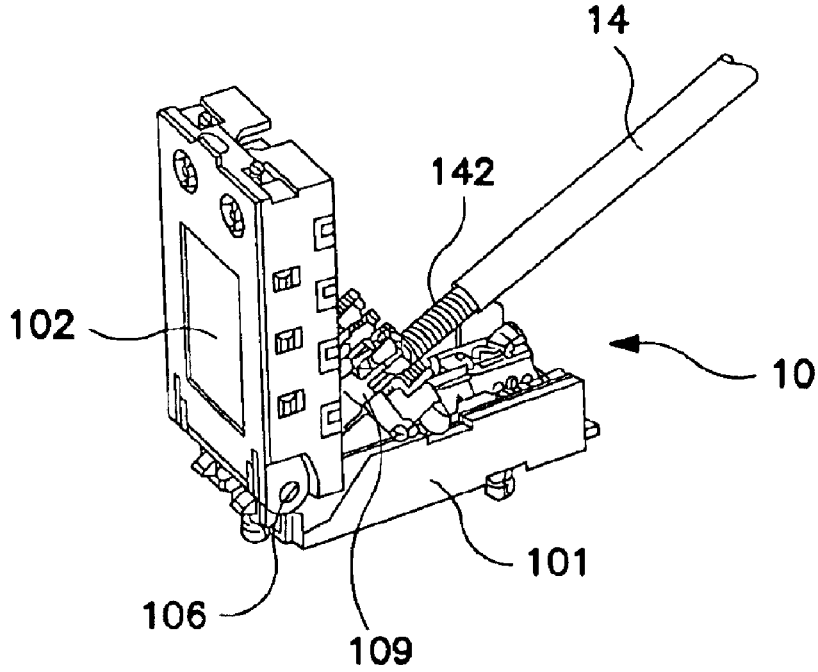
FIG. 4 shows a connection arrangement according to an exemplary embodiment of the invention with an electrical wire suspended in place and a cover opened.

FIG. 4 shows the connection arrangement 10 with the cover 102 pivoted up. Individual wire conductors (not shown) of the shielded electrical wire 14 are laid in the pivot cover 109 to make electrical connections by contact with the insulation displacement contacts 103. Electrical connections are made between the wire conductors and the insulation displacement contacts 103 by pressing in the pivot cover 109. The electrical wire 14 in this case lies largely horizontally in the housing 101. When, the cover 102 is pivoted about a pivot axis 106 it presses on the pivot cover 109 making electrical connections between the wire conductors and the insulation displacement contacts 103. Then the cover 102 is screwed to the housing 101 by means of the securing screws 108.

Figure 5:
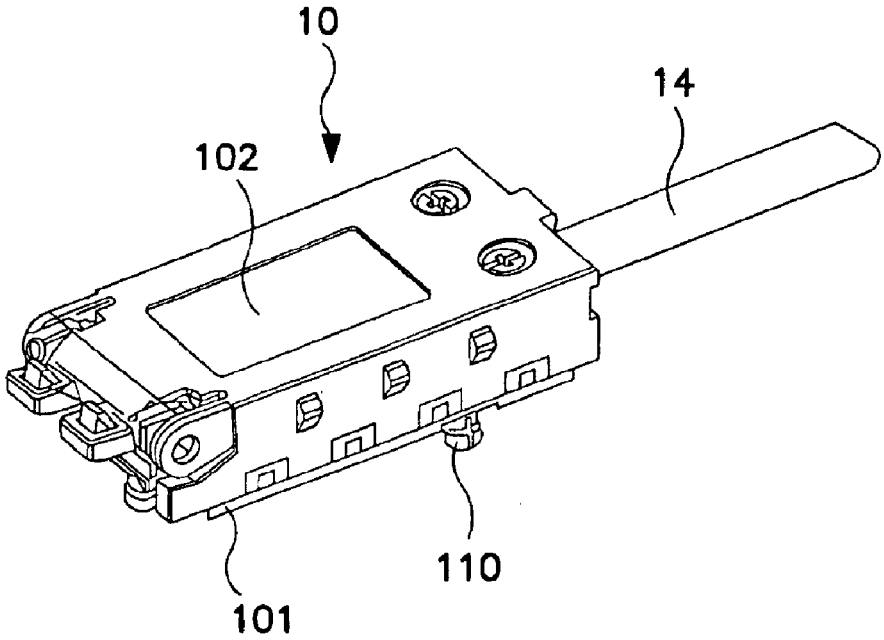
FIG. 5 shows a connection arrangement according to an exemplary embodiment of the invention with the cover closed.

FIG. 5 shows the closed, installed position of the connection arrangement 10. The housing 101 is, in the illustrated embodiment, connected to the printed circuit board in latching manner by means of the latching tabs 110.

Figure 6:
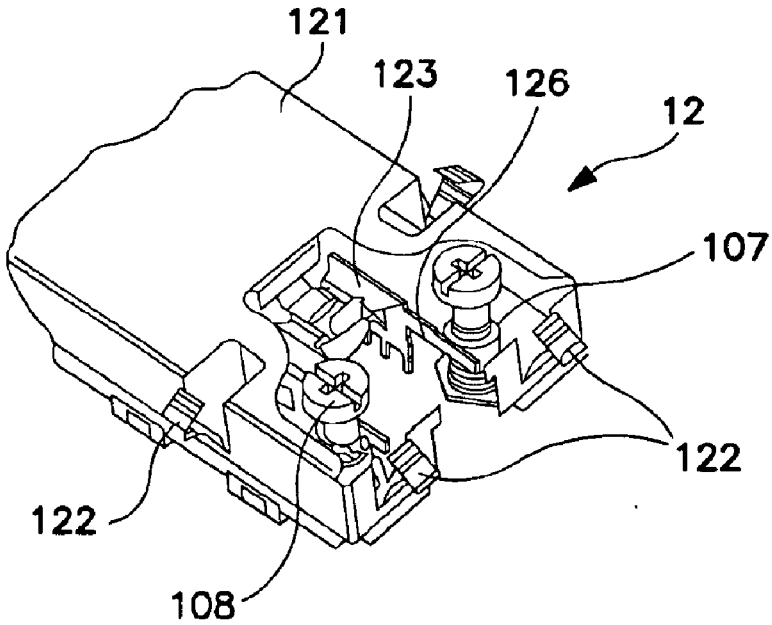
FIG. 6 shows a partial detail view of the shielding of the connection arrangement of FIGS. 4 and 5, FIGS. 7 and 8 show two connection arrangements according to an exemplary embodiment of the invention lying next to one another and seen from below, but with the printed circuit board omitted.

FIG. 6 shows the shielding 12, comprising the shield plate 121 and a small shield plate 123. The cover 102 has been omitted in FIG. 6 for clarity. A recess is present on the upper side of the shield plate 121, facing the cover 102, in the region around the securing screws 108 and above the small shield plate 123. The shielding 12 is, however, significantly improved, and is almost closed, by means of an electrically conductive connection between the small shield plate 123 and the shield plate 121 and by means of an electrically conductive connection between the small shield plate 123 and the securing screws. To this end, the small shield plate 123 has two clamping arms 126 which, when the screws 108 are screwed in, are clamped respectively between the threaded bushing 107 and the securing screw 108.

Figure 7:
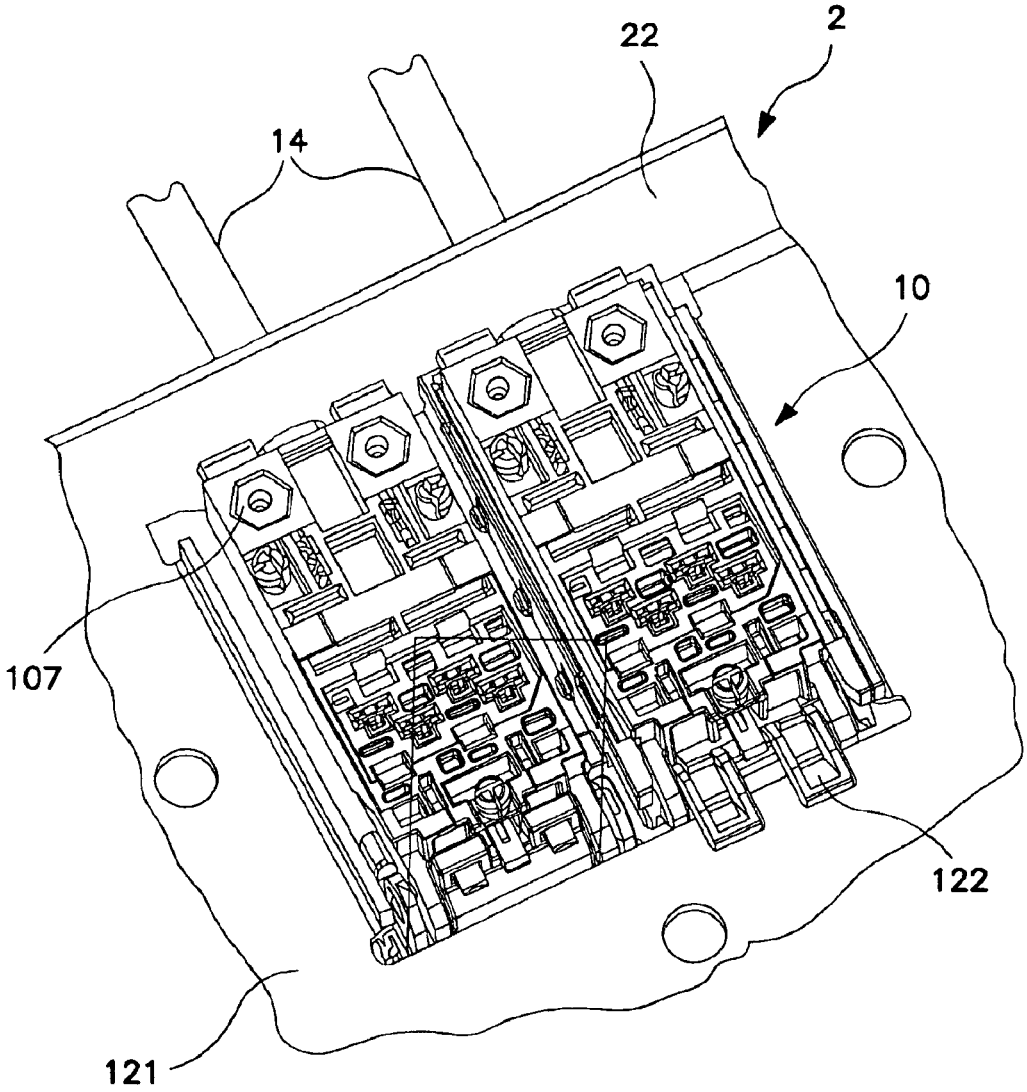

FIG. 7 shows two connection arrangements 10 from below arranged next to one another. For the sake of better clarity, the printed circuit carrier or the printed circuit board has been omitted. In the connection arrangement shown on the left in FIG. 7, the cover has been pivoted up, which is clear from the securing screws 108, which have not yet been screwed into the threaded bushings 107, and the rear resilient tongues 122 of the cover 102, which do not reach under the housing cover 121. In the connection arrangement 10 shown on the right in FIG. 7, the cover 102 has been placed on and screwed to the housing 101. The resilient tongues 122 on the rear short side of the cover 102 reach under the metal housing cover 121 and make an electrical connection therewith.

Figure 8:
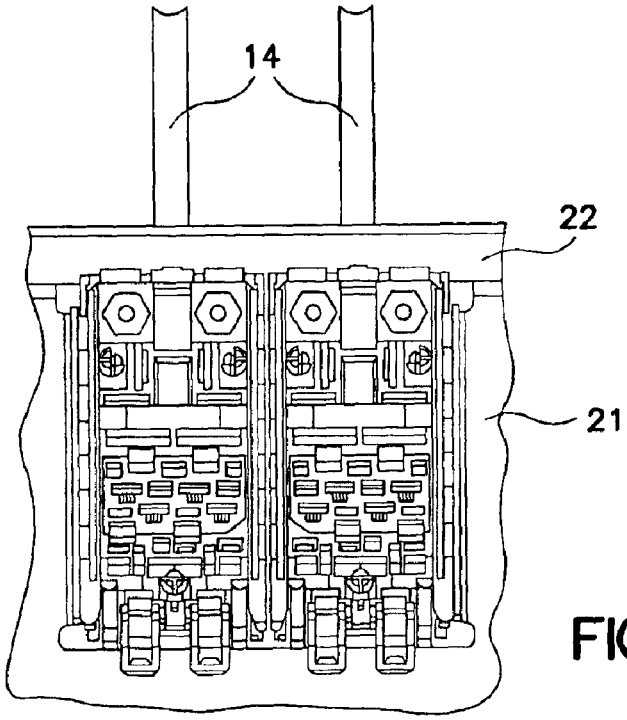

FIG. 8 shows two connection arrangements 10 from below with both covers placed on the housings and screwed thereto.

Figure 9:
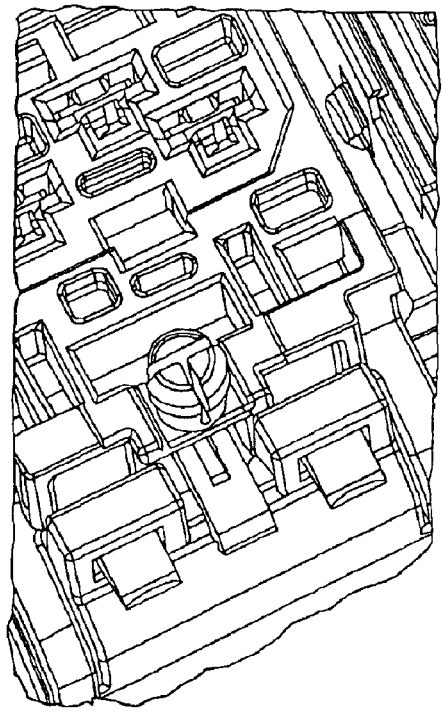
FIG. 9 shows a detail view of the connection arrangement of FIGS. 4 and 5, from below.

FIG. 9 shows the resilient tongues 122 engaged in the cover 102. The resilient tongues 122 can make an electrical connection with the conductive housing 2 or with adjacent connection arrangements 10, and in this way ensure that there is closed shielding of the wire connections.

Figure 10:
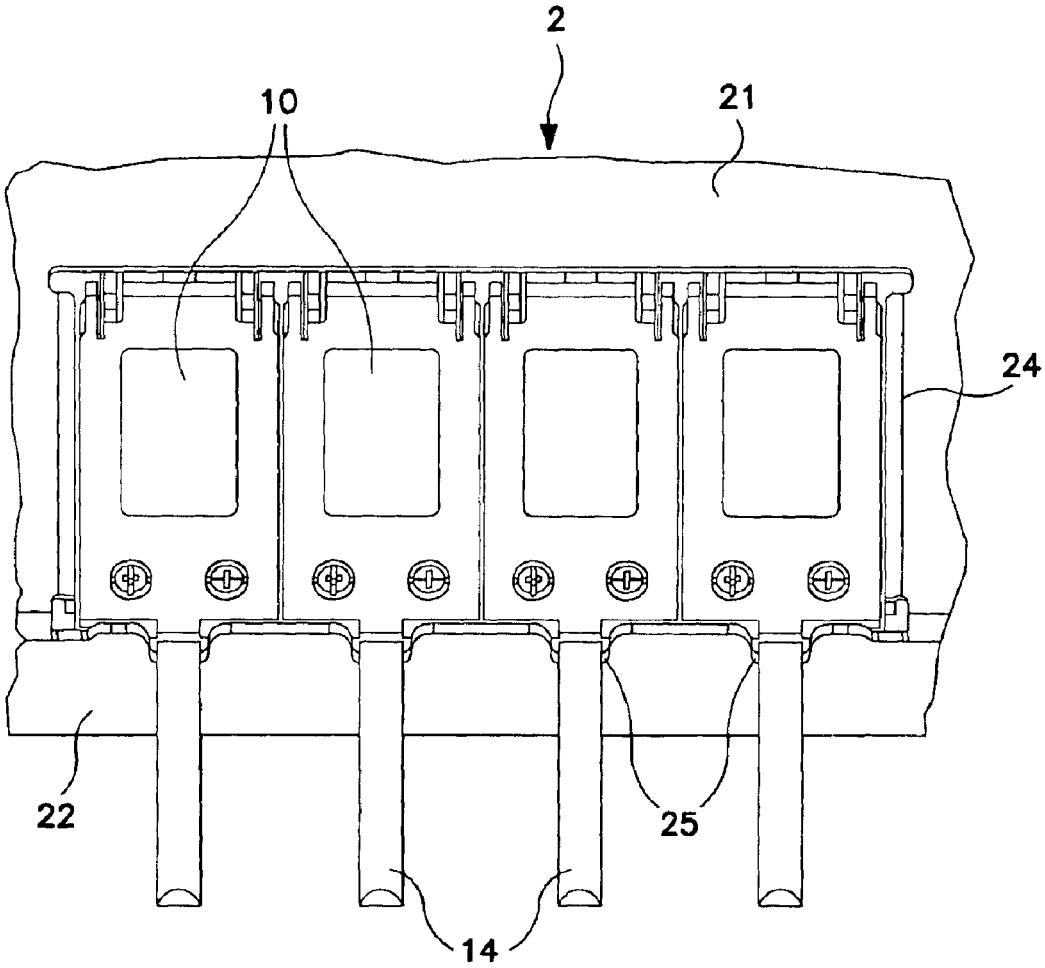
FIG. 10 shows a row of four connection arrangements lying next to one another in a conductive housing according to an exemplary embodiment of the invention.

FIG. 10 shows an example embodiment comprising four connection arrangements 10 lying next to one another and arranged in a conductive housing 2 having a correspondingly large recess 24 in the cover. The housing front wall 22 in this case has a correspondingly large number of wire feedthroughs 25 for the electrical wires 14.

The connection arrangements according to the invention may be used, for example, in a connection known in the industry as industrial Ethernet fast connect connection units. The electromagnetic shielding is achieved by means of a simple punched part to form the shield plate insert. As a result of avoiding the known heavy metal construction (for example of die-cast zinc), a lightweight construction and a low-cost method of manufacture are achieved. A construction which is resilient on all sides of the metal housing ensures reliable electromagnetic shielding. This electromagnetic shielding exists even when there is no wire laid in, because of the electrical connection between all the adjacent metal components. The connection arrangement according to the invention allows components to be fitted to a printed circuit board singly or in rows.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A shielded connection arrangement for electrically connecting at least one multiple-conductor shielded electrical wire to a circuit carrier, the connection arrangement comprising a housing with a securable cover and, arranged in the housing, insulation displacement contacts for making contact with wire conductors of the at least one electrical wire, wherein the housing and the cover are electrically insulating, and an electrically conductive shield plate is disposed within the insulating housing and the cover for shielding the interior of the housing in a manner which is substantially closed, wherein the shield plate is detachably fixed in the cover by means of resilient tongues engaging in apertures formed in the cover.

2. A shielded connection arrangement according to claim 1, wherein the connection arrangement is inserted into a condutive housing with a closed conductive cover, and the resilient tongues are in conductive connection with the conductive housing or the conductive cover or with resilient tongues of an adjacent connection arrangement.

3. A shielded connection arrangement according to claim 1, wherein the cover is mounted to pivot about a pivot axis fixed to the housing.

4. A shielded connection arrangement according to claim 3 wherein the cover is screwed to the housing.

5. A shielded connection arrangement according to claim 1 wherein the insulation displacement contacts are soldered to the printed circuit carrier.

6. A shielded connection arrangement according to claim 1 wherein the housing has on an underside thereof at least two latching connections for securing it to the circuit carrier.

7. A shielded connection arrangement according to claim 1 wherein the housing is formed of insulating material.

8. A shielded connection arrangement for electrically connnecting at least one multiple-conductor shielded electrical wire to a circuit carrier, the connection arrangement comprising a housing with a securable cover and, arranged in the housing, insulation displacement contacts for making contact with wire conductors of the at least one electrical wire, wherein the housing and the cover are electrically insulating, and an electrically conductive shield plate is disposed within the insulating housing and the cover for shielding the interior of the housing in a manner which is substantially close, and an additional small shield plate is disposed within the housing, in electrical connection with a shield of the electrical wire.

9. A shielded connection arrangement according to claim 8 wherein the small shield plate is fixed in electrical connection with the shield plate when the cover is secured.

10. A shielded connection arrangement according to claim 8 wherein the small shield plate is soldered to a ground contact of the printed circuit carrier.

11. A conductive housing of an electrical device or a device module, having one or more shielded connection arrangements arranged next to one another, for electrically connecting at least one multiple-conductor shielded electrical wire to a circuit carrier disposed in the conductive housing, the connection arrangement comprising an insulating housing with a securable insulating cover, and insulating displacement contacts arranged in the insulating housing for making contact with wire conductors of the at least one electrical wire, wherein an electrically conductive shield plate is disposed within the insulating housing and the insulating cover for shielding the interior of the insulating housing in a manner which is substantially closed, the shield plate being detachably fixed in the insulating cover by means of resilient tongues engaging in apertures formed in the insulating cover.

12. A conductive housing according to claim 11, wherein the resilient tongues of the at least one connection arrangement are in electrical connection with the housing or with resilient tongues of an adjacent connection arrangement.

13. A conductive housing according to claim 11 further comprising a conductive cover, wherein the insulating cover of the at least one shielded connection arrangement ends substantially flush with the conductive cover.

14. A conductive housing according to claim 11 wherein the insulating cover is capable of pivoting up mid latching into an end position to allow an electrical connection arrangement to be inserted into the conductive housing.

* * * * *

UNITED STATES PATENT AND TRADEMARK OFFICE

CERTIFICATE OF CORRECTION

PATENT NO. : 6,887,094 B2
DATED : May 3, 2005
INVENTOR(S) : Boeck et al.

It is certified that error appears in the above-identified patent and that said Letters Patent is hereby corrected as shown below:

Column 6,
Line 29, "substantially close, and" should read -- substantially closed, and --.
Line 44, "insulating cover, and insulating" should read -- insulating cover, and insulation --.

Signed and Sealed this

Twenty-first Day of February, 2006

JON W. DUDAS
*Director of the United States Patent and Trademark Office*